US006888518B2

(12) United States Patent
Roh et al.

(10) Patent No.: US 6,888,518 B2
(45) Date of Patent: May 3, 2005

(54) DEVICE AND METHOD FOR EFFICIENTLY DRIVING PLASMA DISPLAY PANEL

(75) Inventors: Chung-wook Roh, Yongin-si (KR); Hye-jeong Kim, Suwon-si (KR); Sang-hun Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 312 days.

(21) Appl. No.: 10/310,140

(22) Filed: Dec. 5, 2002

(65) Prior Publication Data

US 2003/0214462 A1 Nov. 20, 2003

(30) Foreign Application Priority Data

Dec. 11, 2001 (KR) ..... 2001-78181

(51) Int. Cl.[7] ..... G09G 3/28

(52) U.S. Cl. ..... 345/68; 345/55; 345/60; 345/211

(58) Field of Search ..... 345/60, 68, 69, 345/55, 211

(56) References Cited

U.S. PATENT DOCUMENTS 5,828,353 A * 10/1998 Kishi et al. ..... 345/55
6,111,556 A * 8/2000 Moon ..... 345/60
6,628,275 B2 * 9/2003 Vossen et al. ..... 345/211

* cited by examiner

*Primary Examiner*—Richard Hjerpe
*Assistant Examiner*—Tammy Pham
(74) *Attorney, Agent, or Firm*—Sughrue Mion, PLLC

(57) ABSTRACT

A highly-efficient device and method for driving a plasma display panel, by which the voltage stresses of circuit elements, which constitute the driving device, are significantly reduced, and power consumption and heat emission are accordingly reduced. Charging and discharging modes, which constitute a sustain mode, are divided into two first and second charging modes, which are pre-charging and post-charging modes, and two first and second discharging modes, which are pre-discharging and post-discharging modes, respectively. The plasma display driving device is designed so that the two charging modes form different resonance paths passing through different inductors, and the two discharging modes also form different resonance paths passing through different inductors. Consequently, voltage stresses applied to the elements of the driving device are halved. Therefore, high-performance low-priced semiconductor devices can be used to form the plasma display panel driving device, and the reactive power of a plasma display panel can be halved.

27 Claims, 13 Drawing Sheets

<MODE 1>

<MODE 2>

<MODE 3>

<MODE 4>

<MODE 5>

<MODE 6>

<MODE 7>

<MODE 8>

DEVICE AND METHOD FOR EFFICIENTLY DRIVING PLASMA DISPLAY PANEL

BACKGROUND OF THE INVENTION

This application claims the priority of Korean Patent Application No. 2001-78181, filed Dec. 11, 2001, in the Korean Intellectual Property Office, the disclosure of which is incorporated herein in its entirety by reference.

1. Field of the Invention

The present invention relates to a driving device and method for plasma display panels, and more particularly, to a highly-efficient device and method for driving a plasma display panel, by which the voltage stresses of circuit elements, which constitute the driving device, are significantly reduced, and power consumption and heat emission are accordingly reduced.

2. Description of the Related Art

A plasma display panel (PDP) is a next-generation flat-panel display that displays characters or images using plasma produced by gas discharge. The number of pixels of a PDP, pixels that are two-dimensionally arranged, ranges from several hundreds of thousands to several millions according to the size of a PDP.

FIG. 1 is a circuit diagram of a conventional Webber-type alternating current plasma display panel (AC-PDP) sustaining discharge circuit. In this case, the AC-PDP can be assumed to be a panel capacitance Cp. In FIG. 2, (a)–(j) show the waveforms of switch control signals for switching sequences, the waveform of an output voltage $v_p$ at both ends of a plasma display panel obtained based on the switch control signals, and the waveform of current iL, which flows through an inductor Lc. The AC-PDP sustaining discharge circuit can be expressed in the following four modes according to a switching sequence.

In mode 1, immediately before a MOSFET switch Sa1 is turned on, Sx2 is turned on, and both-end voltage $v_p$ is maintained 0V. When Sa1 is turned on at t0, mode 1 starts being performed During mode 1, an Lc resonance circuit is formed along a path of Cc1-Sa1-Da-Lc1-C (panel). Accordingly, a resonance current flows through an inductor Lc1, and $v_p$ increases. At t1, the current of an inductor on the upper side is 0A, and $v_p$ is equal to +Vpk.

In mode 2, at t2, Sa1 is turned off and Sy1 is turned on. At this time, the both-end voltage $v_p$ for Sy1 is changed by Vpk, so a switching loss is generated. During mode 2, $v_p$ is kept to be+Vs, and the panel maintains a discharge state.

In mode 3, at t3, Sa2 is turned on while Sy1 is turned off. During mode 3, an LC resonance circuit is formed along a path of C-Lc1-Da2-Sa2-Cc1. Accordingly, a resonance current flows through the inductor Lc1, and $v_p$ decreases. At t3, the current of an inductor on the lower side is 0A, and $v_p$ is decreased to +Vpk.

In mode 4, at t4, Sa2 is turned off, while Sy2 is turned on. At this time, since the both-end voltage $v_p$ for Sy2 is +Vpk, a switching loss is generated. During mode 4, $v_p$ is maintained to be 0V.

Looking at the voltage stresses of semiconductor devices in the conventional AC-PDP sustaining discharge circuit as described above, a voltage stress of sustaining discharge MOSFET switches Sy1, Sy2, Sx1, and Sx2 is +Vs, a voltage stress of energy recovery MOSFET switches Sa1, Sa2, Sb1, and Sb2 is +Vs/2, and a voltage stress of diodes Da1, Da2, Db1, Db2, Dc1, Dc2, Dc3, and Dc4 is +Vs/2 Considering the fact that a typical PDP operates at a voltage Vs in the range of 160V to 190V, these semiconductor devices are expensive. In addition, parasitic resistance and parasitic capacitance increase, which causes an increase in power loss during switching, and an increase in electromagnetic interference (EMI) and noise in PDP driving circuits.

SUMMARY OF THE INVENTION

To solve the above and other problems, it is an aspect of the present invention to provide a highly-efficient device and method for driving a plasma display panel, by which the voltage stresses of circuit elements are reduced. In a plasma display panel driving system, a charging mode and a discharging mode, which are executed during a sustain period, are divided into two charging modes and two discharging modes, respectively Switching of the driving device is controlled so that the two charging modes form different resonance paths including different inductors and the two discharging modes form different resonance paths including different inductors.

The above and other aspects of the present invention are achieved by a highly-efficient sustain driving device for a plasma display panel, the sustain driving device including a sustain switching unit and an energy recovery unit. The sustain switching unit connects first and second terminals of the energy recovery unit to the plasma display panel according to a predetermined sustain discharge sequence. According to a predetermined energy recovery sequence, the energy recovery unit divides charging and discharging modes, which constitute a sustain mode, into first and second charging modes and first and second discharging modes, respectively. The first and second charging modes and the first and second discharging modes form different resonance paths, and current flowing along the different resonance paths passes through the first and second terminals and charges/discharges the plasma display panel.

The above and other aspects of the present invention are also achieved by a method of efficiently driving a plasma display panel. In an energy recovery circuit having two inductors, this method is performed according to a switching sequence in which a reset period, an address period, and a sustain period repeat. In this method, charging and discharging modes, which are executed during the sustain period, are divided into first and second charging modes and first and second discharging modes, respectively. The first and second charging modes form different resonance paths that pass different inductors, and the first and second discharging modes also form different resonance paths that pass different inductors. The switching sequence is controlled to charge/discharge the plasma display panel.

The above and other aspects of the present invention are still achieved by a system for driving a plasma display panel according to a switching sequence in which a reset period, an address period, and a sustain period repeat. In the system, an Y-electrode sustain driving circuit divides charging and discharging modes, which are executed to apply a high-frequency square wave voltage to Y electrodes of the plasma display panel during a sustain period, into first and second charging modes and first and second discharging modes, respectively. The Y-electrode sustain driving circuit also forms different resonance paths, which pass different inductors, for the first and second charging modes and different resonance paths, which pass different inductors, for the first and second discharging modes, and drives the Y electrodes of the plasma display panel to be charged/discharged. A separating and reset circuit separates a circuit operation during the sustain period, a circuit operation during the address period, and a circuit operation during the rest period from one another and applies a lamp-type high-pressure voltage during the reset period. A scan pulse generator applies a horizontal synchronization signal during the address period and being short-circuited during the other periods. An X-electrode sustain driving circuit divides charging and discharging modes, which are executed to apply a high-frequency square wave voltage to X electrodes of the plasma display panel during a sustain period, into first and second charging modes and first and second discharging modes, respectively. The X-electrode sustain driving circuit forms different resonance paths, which pass different inductors, for the first and second charging modes and different resonance paths, which pass different inductors, for the first and second discharging modes, and drives the X electrodes of the plasma display panel to be charged/discharged.

BRIEF DESCRIPTION OF THE DRAWINGS

The above and other aspects and advantages of the present invention will become more apparent by describing in detail preferred embodiments thereof with reference to the attached drawings in which.

DETAILED DESCRIPTION OF THE INVENTION

Figure 1:
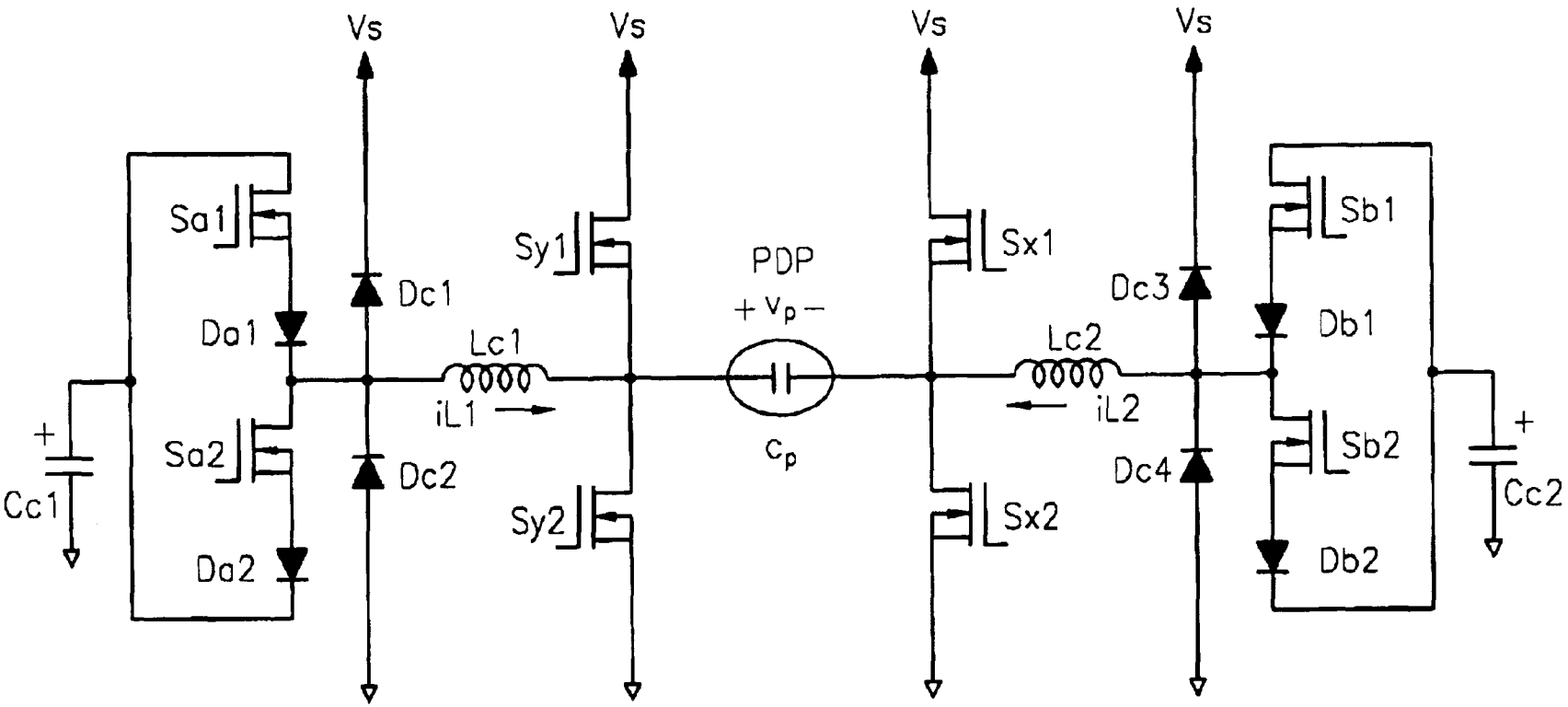
FIG. 1 (PRIOR ART)
FIG. 1 is a circuit diagram of a conventional plasma display panel driving device.
Figure 2:
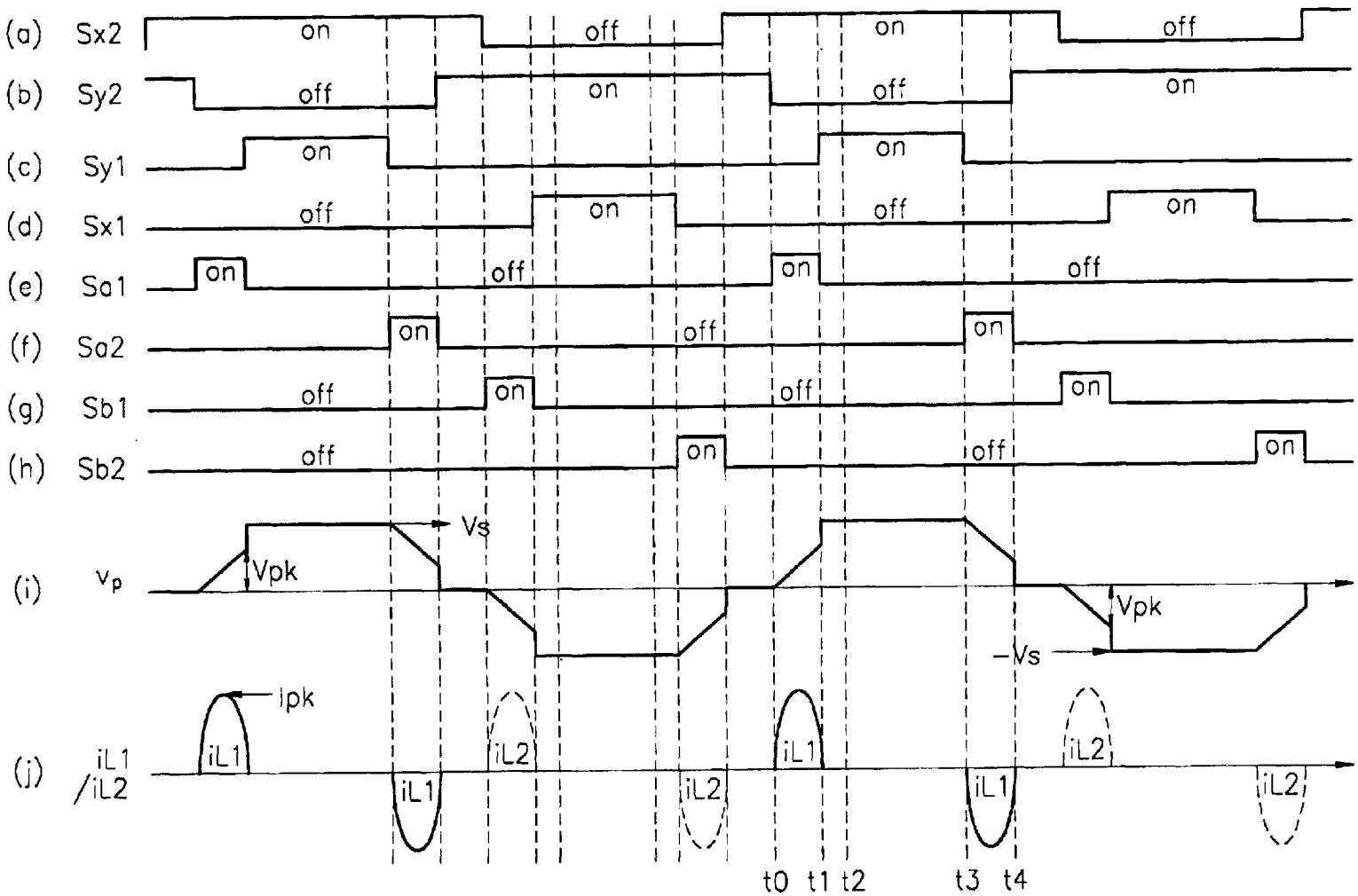
FIG. 2 (PRIOR ART)
FIG. 2 shows a variety of switching control signals applied to the plasma display panel driving device of FIG. 1 and the voltage/current waveforms of the panel.
Figure 3:
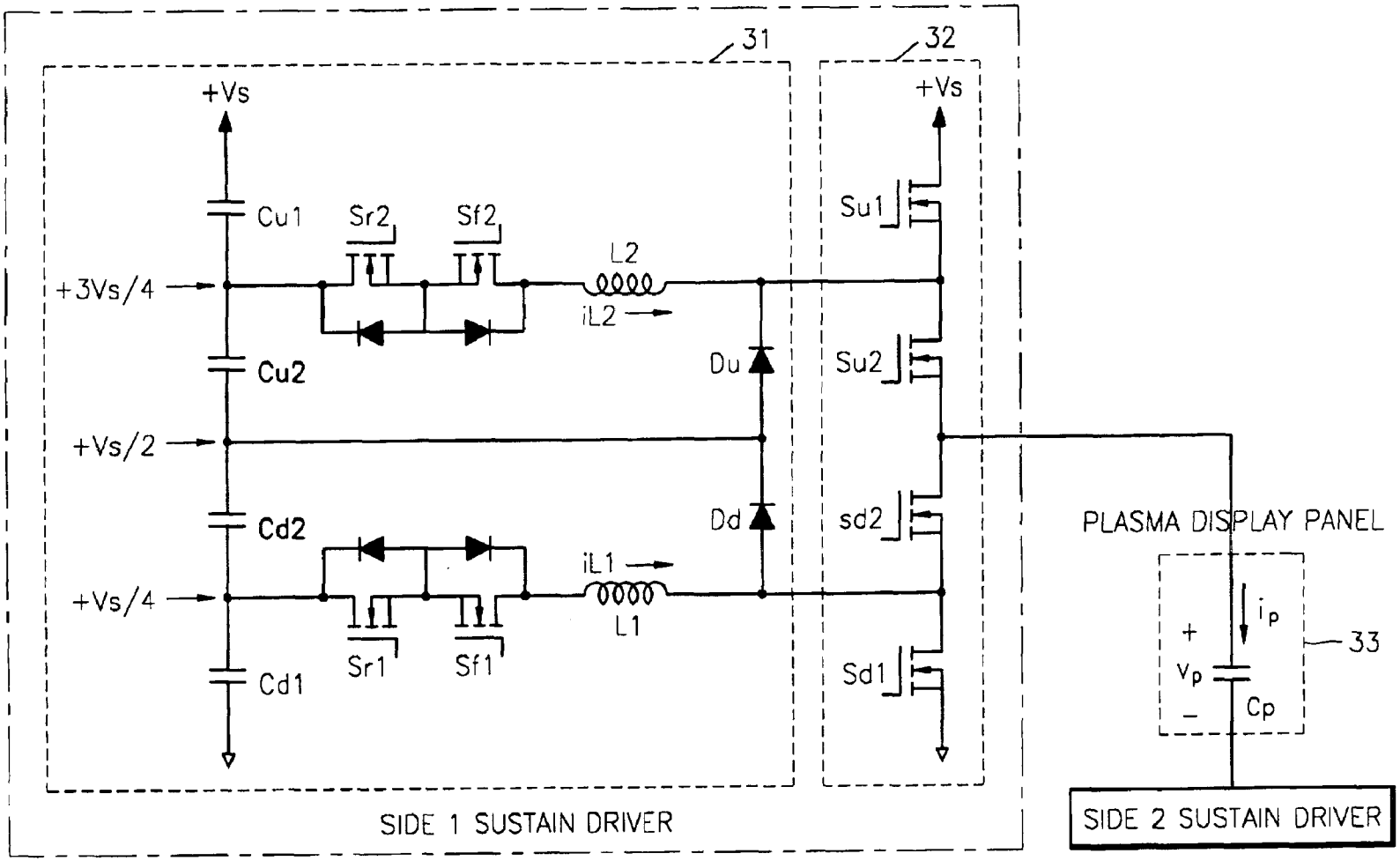
FIG. 3 is a circuit diagram of a highly-efficient sustain driving device according to the present invention for plasma display panels.

Referring to FIG. 3, a highly-efficient sustain driving device according to the present invention for plasma display panels includes an energy recovery unit 31, a sustain switching unit 32, and a plasma display panel 33. In the energy recovery unit 31, different resonance paths are formed for a first charging (pre-charging) mode, a second charging (post-charging) mode, a first discharging (pre-discharging) mode, and a second discharging (post-discharging) mode in accordance with a energy recovery sequence according to the present invention. Current flowing along the resonance paths passes through first and second terminals and charges/discharges the plasma display panel 33. The aforementioned four modes constitute a sustain mode.

The energy recovery unit 31 includes first and second inductors L1 and L2, a fifth switch (Sr1, Sf1), a sixth switch (Sr2, Sf2), and four capacitors Cd1, Cd2, Cu2, and Cu1 The first and second inductors L1 and L2 are connected to the first and second terminals, respectively. The fifth and sixth switches (Sr1, Sf1) and (Sr2, Sf2) are connected to the terminals of the first and second inductors, respectively, and bilaterally switch current according to a predetermined energy recovery sequence. To be more specific, the energy recovery unit 31 includes a charging element block and a mode separation unit. In the charging element block, the four capacitors Cd1, Cd2, Cu2, and Cu1 are sequentially connected in series. A ground line and a sustain supply voltage Vs are applied to the terminals of the first and fourth capacitors Cd1 and Cu1, respectively. The fifth and sixth switches (Sr1, Sf1) and (Sr2, Sf2) are connected to the coupling terminal of the first and second capacitors Cd1 and Cd2 and that of the third and fourth capacitors Cu2 and Cu1, respectively. In the mode separation unit, two diodes Dd and Du for unilaterally switching current are serially coupled. The terminals of the two diodes Dd and Du are connected to the first and second terminals of the energy recovery unit 31, respectively, and the coupling terminal of the diodes Dd and Du is connected to the coupling terminal of the second and third capacitors Cd2 and Cu2. In the mode separation unit having this structure, the first and second charging modes are separated from each other, and the first and second discharging mode are separated from each other The sustain switching unit 32 connects the first and second terminals of the energy recovery unit 31 to the plasma display panel 33 in accordance with a sustain charge sequence according to the present invention.

To be more specific, the sustain switching unit 32 includes first through fourth switches Sd1, Sd2, Su2, and Su1 that are sequentially connected to one another in series. A ground line and a sustain supply voltage Vs are applied to the terminals of the first and fourth switches Sd1 and Su1, respectively. The plasma display panel 33 is connected to the coupling terminal of the second and third switches Sd2 and Su2. The first and second terminals of the energy recovery unit 31 are connected to the coupling terminal of the first and second switches Sd1 and Sd2 and that of the third and fourth switches Su2 and Su1, respectively.

Referring to FIG. 3, the energy recovery unit 31 and the sustain switching unit 32 are only shown on the side 1 electrode of the plasma display panel 33. However, the same sustain driver as that on the side 1 electrode is provided on the side 2 electrode of the plasma display panel 33.

Figure 5:
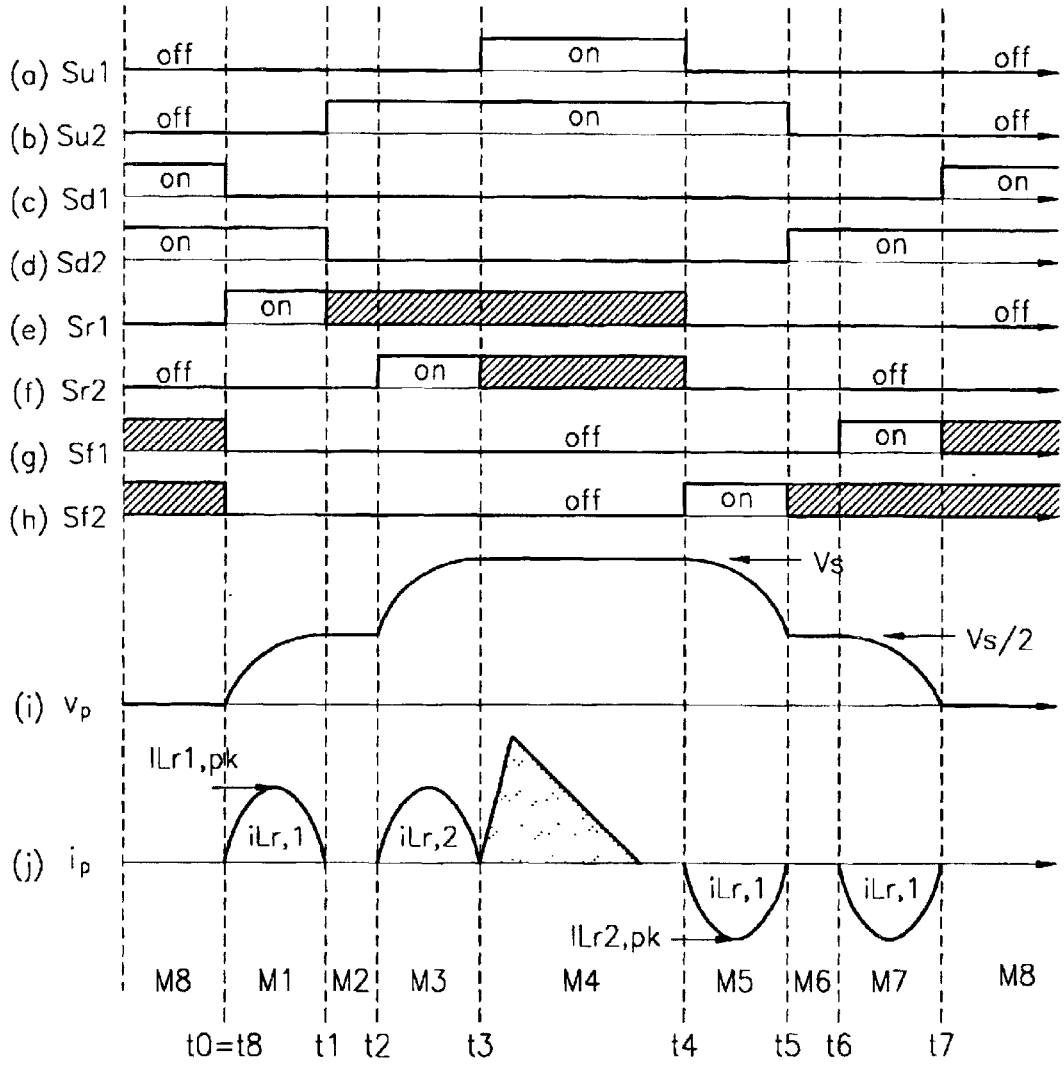
FIG. 5 shows switching control signals and the voltage/current waveforms applied to the panel of FIG. 4.

The hatched portions in FIG. 5 denote sections in which conduction or blocking of a gate signal does not make any difference in respect of a PDP drive. In order to perform circuit interpretation, it is assumed that both end voltages of each of the first through fourth capacitors Cd1, Cd2, Cu2, and Cu1 of the charging element block are each maintained to be+Vs/4, and that the inductors L1 and L2 of the energy recovery unit 31 have the same inductance. FIGS. 6A through 6H show different equivalent circuits for individual modes based on a switching sequence according to the present invention. The execution of each mode during a half period while an individual gate signal is applied, according to the present invention, will now be described.

1. Mode 1 (t0–t1; pre-charging)

Figure 6A:
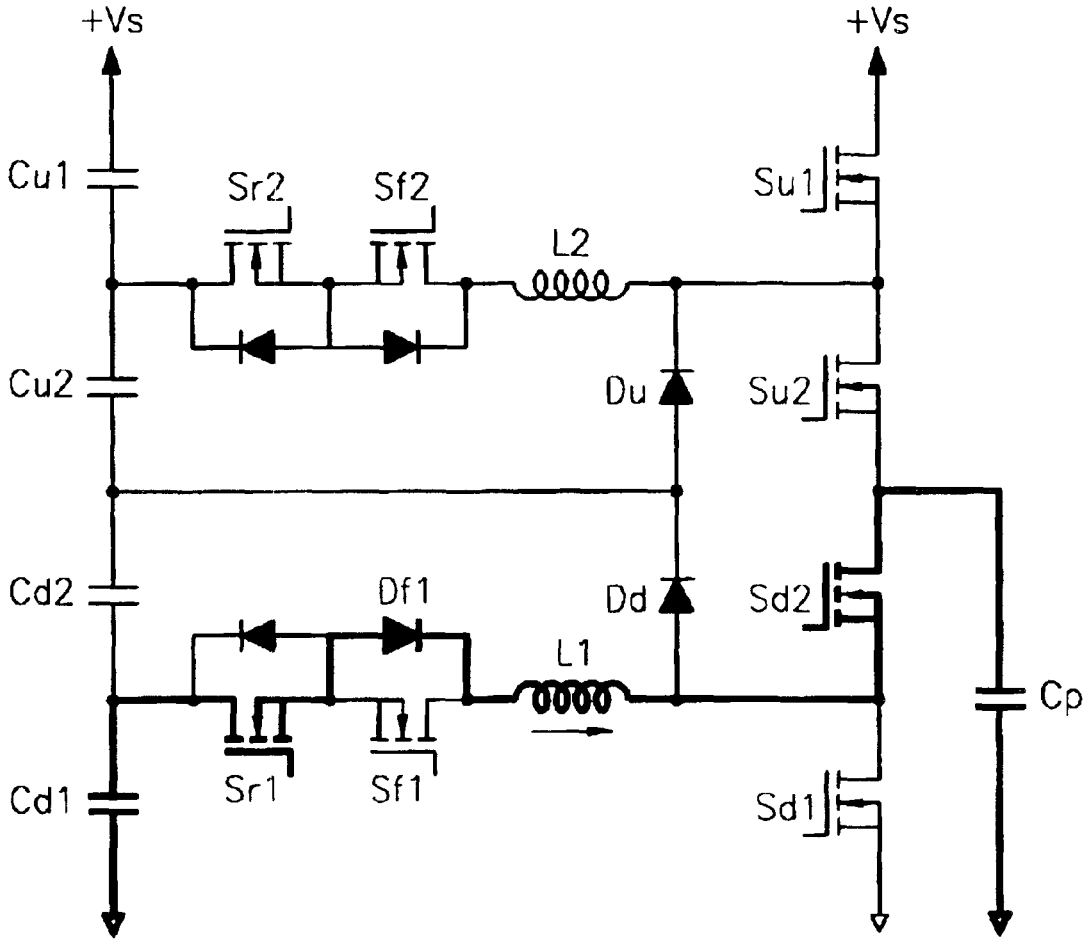
FIGS. 6A through 6H show current conduction paths for a variety of modes that depends on a switching sequence according to the present invention and are executed in a sustain period.

Immediately before t=t0, switches Sd1 and Sd2 are turned on, and accordingly the panel voltage $v_p$ is maintained to be 0V. The drain-source voltage of each of switches Su1 and Su2 is +Vs/2. At t=t0, if the switch Sd1 is turned off, and an energy recovery switch Sr1 is turned on, a PDP capacitor Cp is charged along a resonance path of Cd1-Sr1-Df1-L1-Sd2-Cp as shown in FIG. 6A. In this case, the panel voltage $v_p$ and the current $i_{L1}$ of the inductor L1 are expressed as in Equations 1 and 2, respectively ω and $Z_n$ in Equations 1 and 2 are expressed as in Equation 3.

$$v_P(t) = \frac{V_s}{4}(1 - \cos\omega_n t) \quad (1)$$

$$i_{L1}(t) = \frac{V_s}{4Z_n}\sin\omega_n t \quad (2)$$

$$\omega_n = \frac{1}{\sqrt{LC_p}},\ Z_n = \sqrt{\frac{L}{C_p}} \quad (3)$$

The panel voltage $v_p$ increases from 0V to +Vs/2, and the panel current ip is restricted to a maximum value of Vs/(4*$Z_n$). At t=t1, when the panel voltage $v_p$ is +Vs/2, mode 1 is terminated.

2. Mode 2 (t1–t2; +Vs/2 Mode)

Figure 6B:
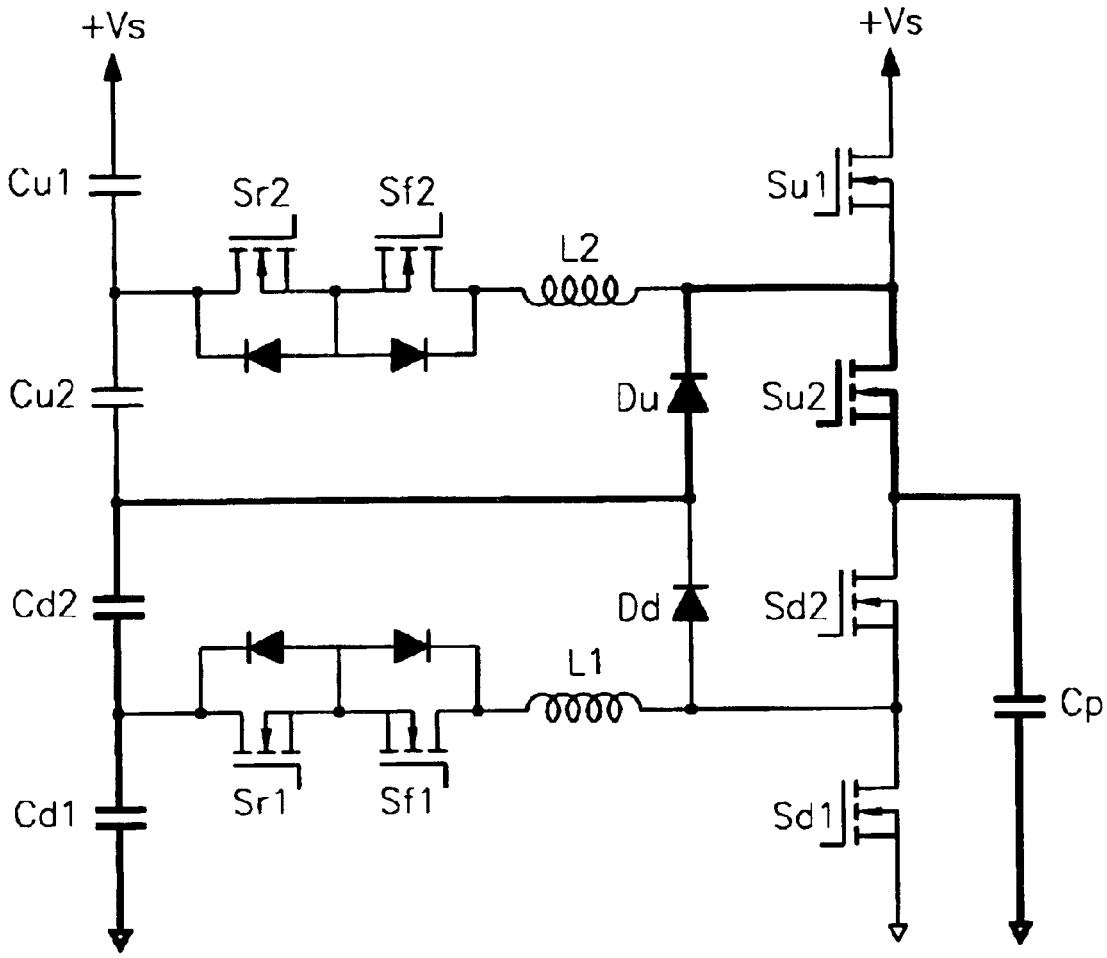

As shown in FIG. 6B, at t=t1, the switch Sd2 is turned off, and the switch Su2 is turned on on a zero voltage switching condition in which a drain-source voltage is 0V. The panel voltage $v_p$ is maintained to be+Vs/2. The timing of a gate signal is designed so that a duration for mode 2 can be as short as possible to achieve a high frequency operation.

3. Mode 3 (t2–t3, post-charging)

Figure 6C:
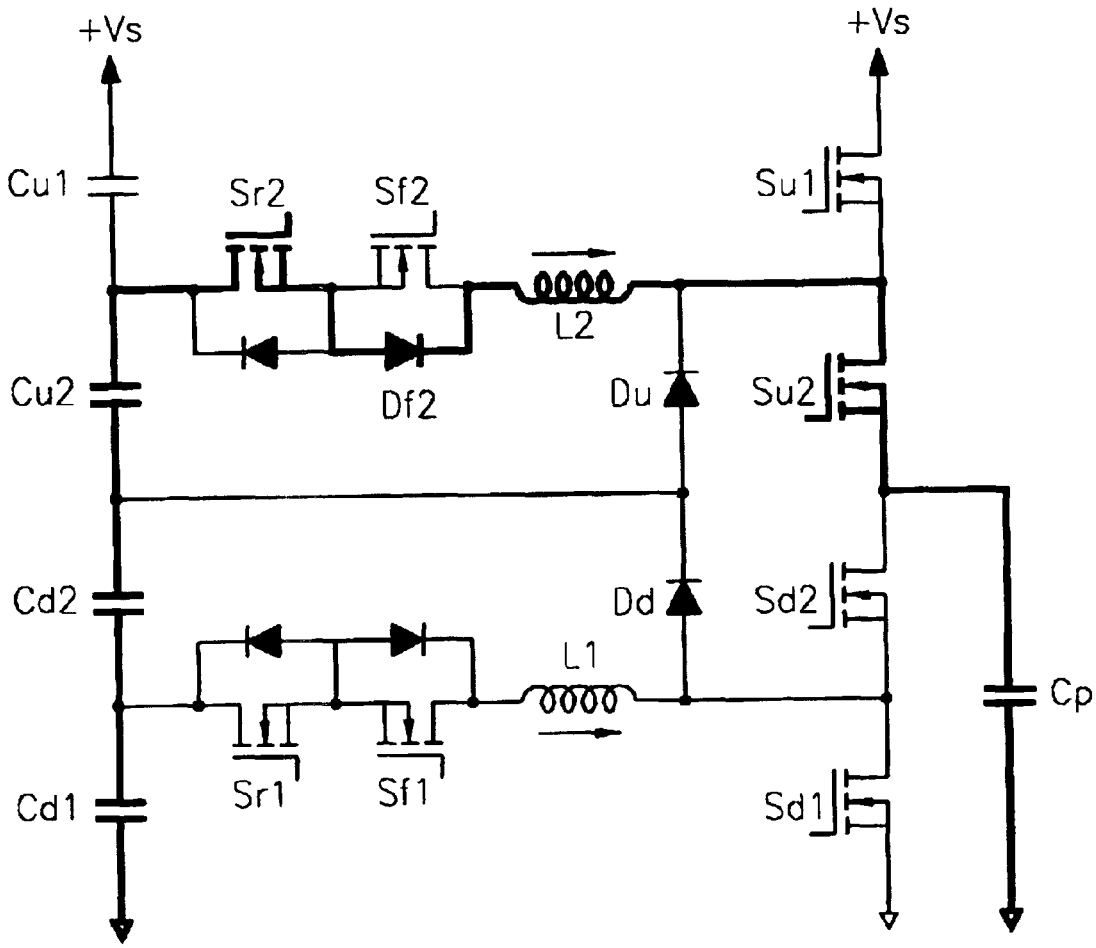

At t=t2, when an energy recovery switch Sr2 is turned on, mode 3 starts being executed Then, as shown in FIG. 6C, the panel voltage $v_p$ increases to +Vs/2 by passing a resonance path of Cd1-Cd2-Cu2-Sr2-Df2-L2-Su2-Cp. In mode 3, the panel voltage $v_p$ and the the current $i_{L2}$ of the inductor L2 are expressed as in Equations 4 and 5, respectively:

$$v_P(t) = \frac{V_s}{4}(3 - \cos\omega_n t) \quad (4)$$

$$i_{L2}(t) = \frac{V_s}{4Z_n}\sin\omega_n t \quad (5)$$

Accordingly, the panel voltage $v_p$ increases from +Vs/2 to +Vs, and the panel current $i_p$ is restricted to a maximum value of Vs/(4*$Z_n$) as in mode 1. At t=t3, when the panel voltage $v_p$ is +Vs, mode 3 is terminated. The duration of mode 1 is equal to the duration of mode 3

4. Mode 4 (t3–t4; light emission)

Figure 6D:
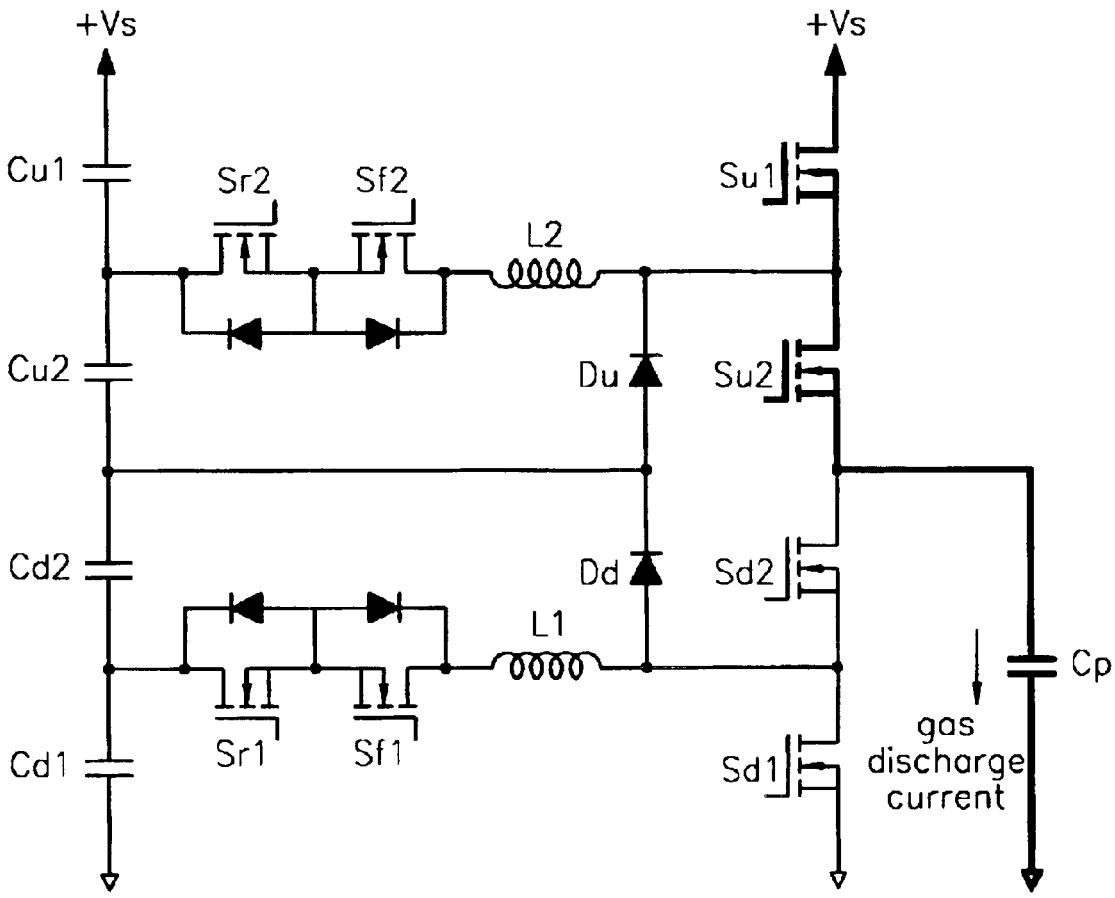

At t=t3, the switch Su1 is turned on on the zero voltage switching condition. As shown in FIG. 6D, in mode 4, the panel voltage $v_p$ is maintained to be Vs, and the sustain charging current of a PDP flows The duration for mode 4 is determined depending on a discharging material of a PDP. Typically, the duration for mode 4 is set to be 1.7 μs or longer.

5. Mode 5 (t4–t5; pre-discharging)

Figure 6E:
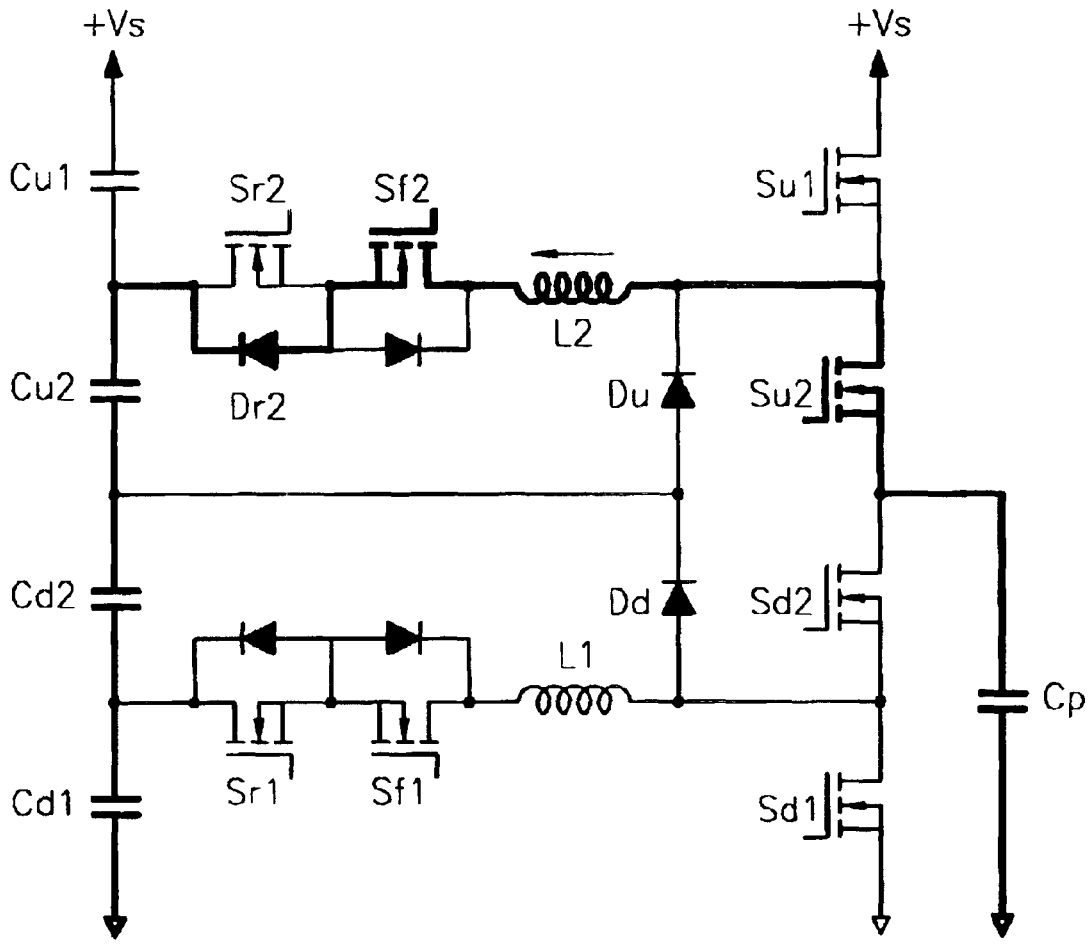

At t=t4, the switch Su2 is turned off, and an energy recovery switch Sf2 is turned on. Accordingly, as shown in FIG. 6E, a panel discharges along a resonance path of Cp-Su2-L2-Sf2-Dr2-Cu2-Cd2-Cd1. In mode 5, the panel voltage $v_p$ and the current $i_{L2}$ of the inductor L2 are expressed as in Equations 6 and 7, respectively:

$$v_P(t) = \frac{V_s}{4}(3 + \cos\omega_n t) \quad (6)$$

$$i_{L2}(t) = \frac{V_s}{4Z_n}\sin\omega_n t \quad (7)$$

Accordingly, in mode 5, the panel voltage $v_p$ decreases from +Vs to +Vs/2, and the discharge current of the panel is restricted to Vs/(4*$Z_n$) At t=t5, the panel voltage $V_p$ Is+Vs/2, and mode 5 is terminated.

6. Mode 6 (t5–t6; +Vs/2 Mode)

Figure 6F:
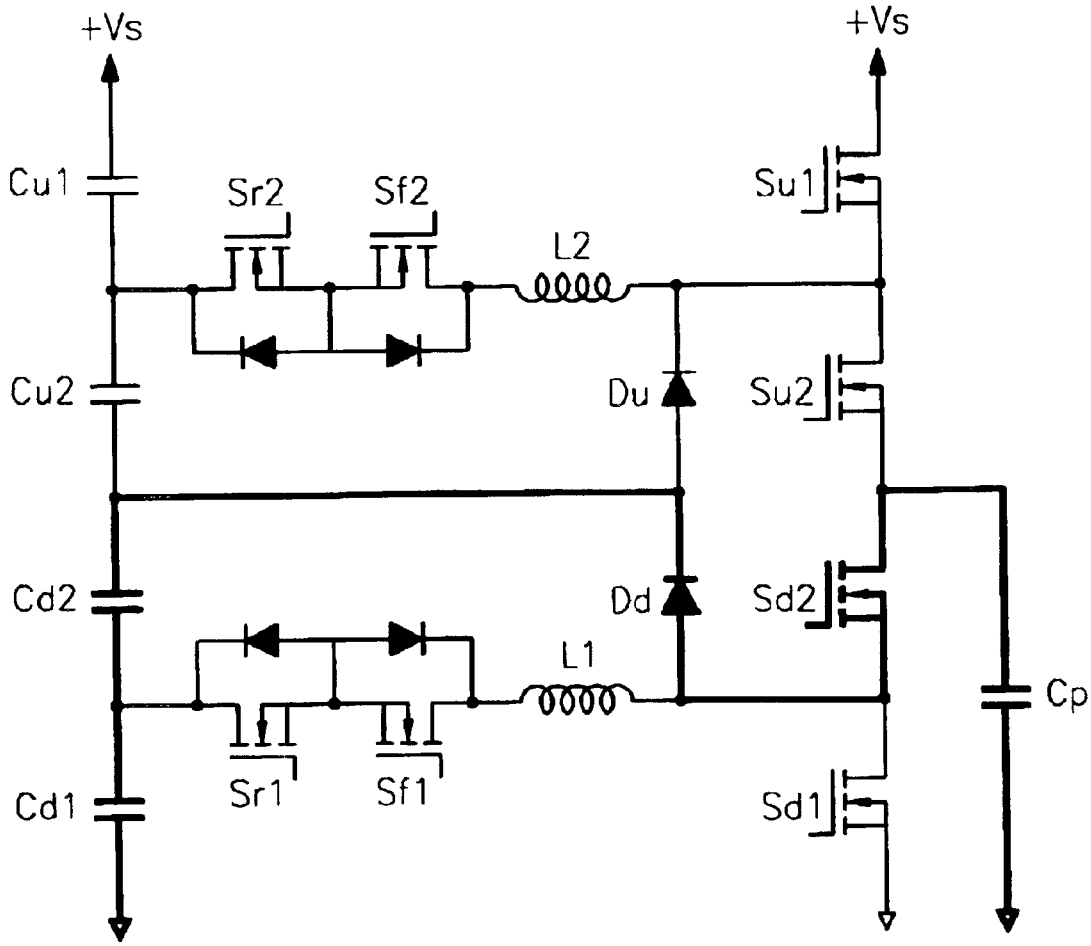

As shown in FIG. 6F, at t=t5, the switch Su2 is turned off, and the switch Sd2 is turned on so as to meet the zero voltage switching condition. The panel voltage Vp is maintained to be+Vs/2 As in mode 2, a gate signal is designed so that the duration of mode 6 is as short as possible to achieve a high frequency operation.

7. Mode 7 (t6–t7; post-discharging)

Figure 6G:
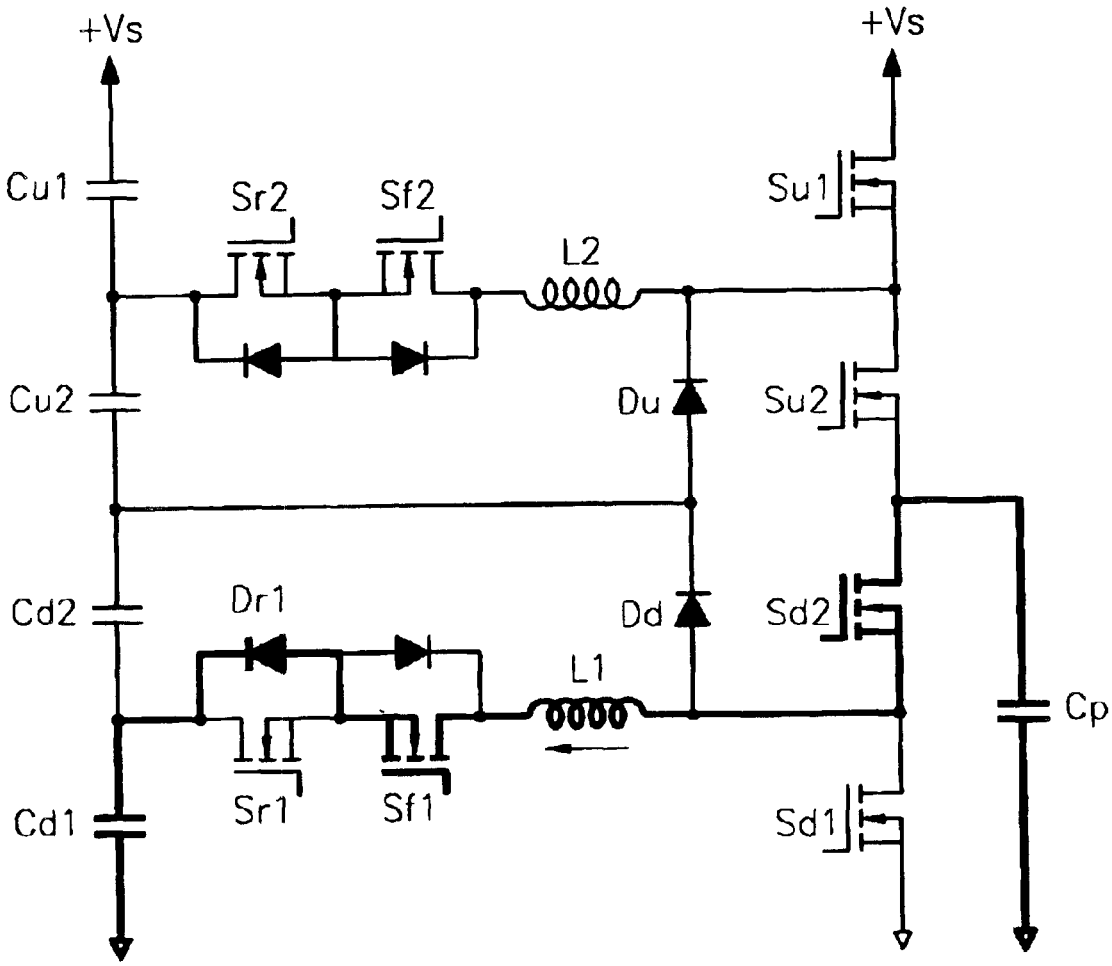

At t=t6, when an energy recovery switch Sf1 is turned on, mode 7 starts. As shown in FIG. 6G, the panel voltage $V_p$ decreases from +Vs/2 to 0 by passing through a resonance path of Cp-Sd2-L1-Sf1-Dr1-Cd1. In mode 7, the panel voltage $V_p$ and the current $i_{L2}$ of the inductor L2 are expressed as in Equations 8 and 9, respectively:

$$v_P(t) = \frac{V_s}{4}(1 + \cos\omega_n t) \quad (8)$$

$$i_{L2}(t) = \frac{V_s}{4Z_n}\sin\omega_n t \quad (9)$$

At t=t7, when the panel voltage $v_p$ is 0, mode 7 is terminated. The duration of mode 5 is equal to the duration of mode 7.

8. Mode 8 (t7–t8, ground mode)

Figure 6H:
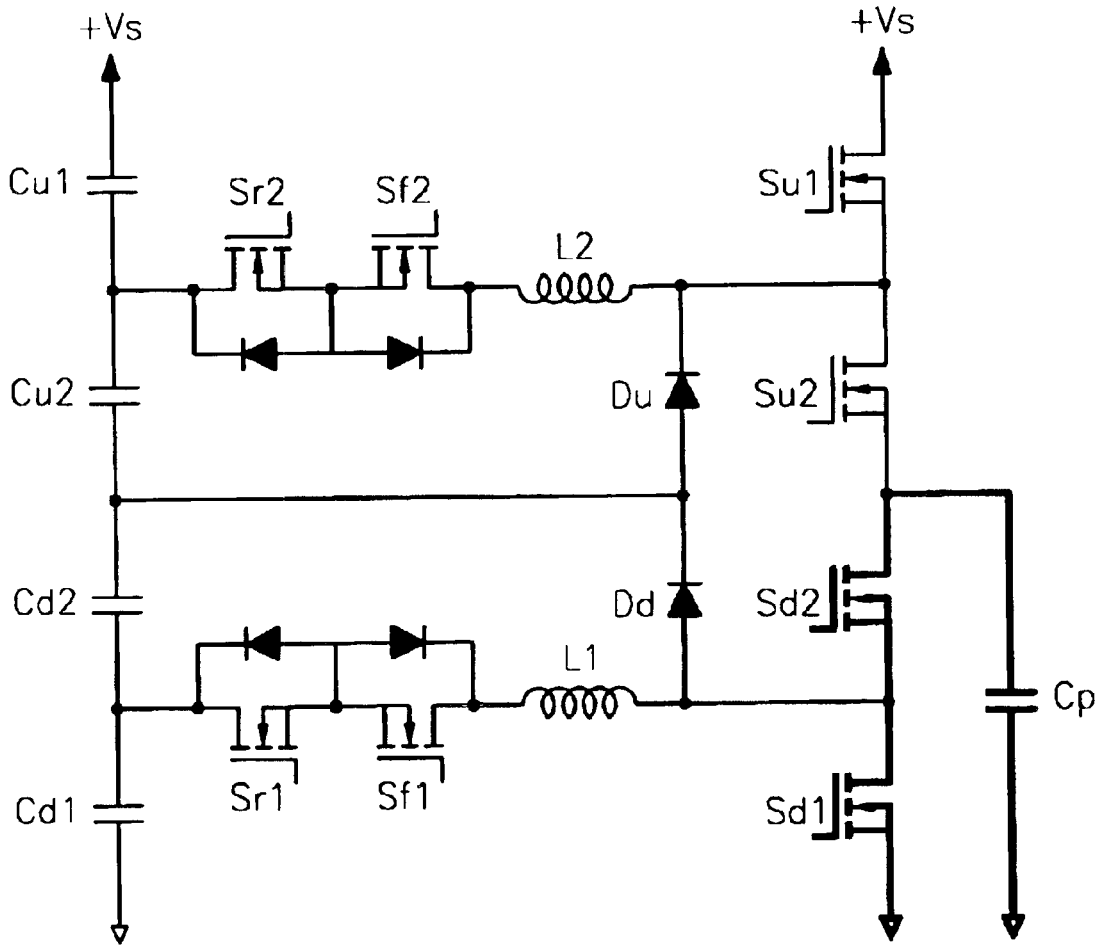

As shown in FIG. 6H, at t=t7, the switch Sd1 is turned on so as to meet the zero voltage switching condition, and the panel voltage $v_p$ is 0V.

The above-described modes 1 through 8 are executed during a half period in a sustain driver on the side 1 electrode of a plasma display panel. The modes 1 through 8 are repeated during the other half period in a sustain driver on the side 2 electrode of the plasma display panel. Accordingly, a high frequency AC voltage is applied to the plasma display panel.

Figure 4:
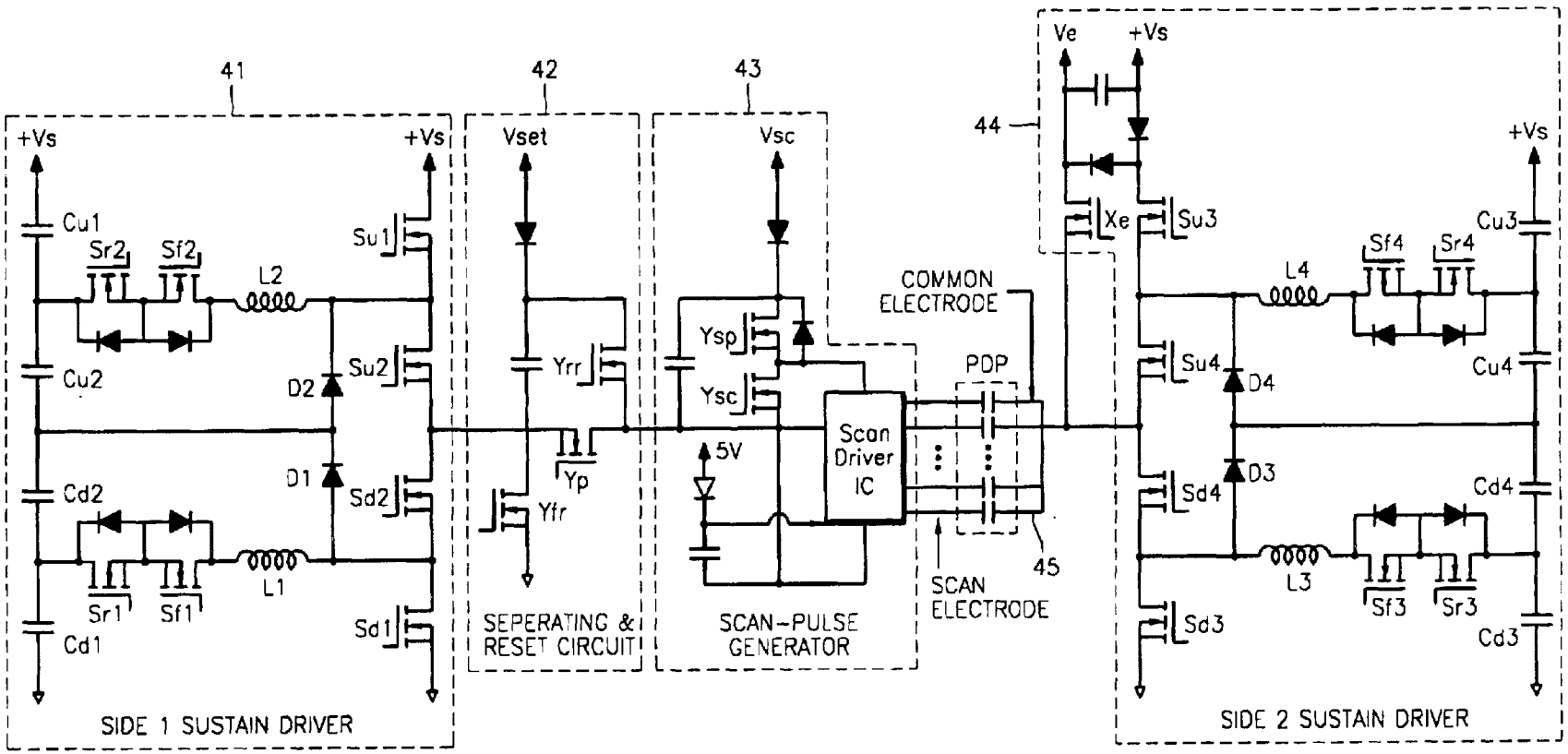
FIG. 4 is a circuit diagram of a system for driving a plasma display panel, the system adopting a highly-efficient sustain driving device according to the present invention for plasma display panels.

FIG. 4 is a circuit diagram of a system for driving a plasma display panel, the system adopting a highly-efficient sustain driving device of FIG. 3. The plasma display panel driving system includes a Y-electrode sustain driving circuit (side 1 sustain driver) 41, a separating & reset circuit 42, a scan pulse generator 43, and an X-electrode sustain driving circuit (side 2 sustain driver) 44, and a plasma display panel 45.

Since the Y-electrode and X-electrode sustain driving circuits 41 and 44 were described in detail with reference to FIG. 3, they will not be described here.

In the separating & reset circuit 42, a separation circuit Yp is a switch for separating a circuit operation during a sustain period from a circuit operation during the other periods, such as an address period or a reset period. Reset circuits Yfr and Yrr are switches for applying a lamp-type high-pressure voltage to the panel during the reset period.

The scan pulse generator 43 operates to apply a horizontal synchronization signal to a PDP screen during an address period and is short-circuited during the other periods.

As already described in FIG. 3, in the plasma display panel system of FIG. 4, charging and discharging modes that are executed during a sustain period are also divided into two charging modes, which are pre-charging and post-charging modes, and two discharging modes, which are pre-discharging and post-discharging modes, respectively. The plasma display panel driving system of FIG. 4 is designed so that the two charging modes form different resonance paths via different inductors L1 and L2 and that the two charging modes are designed so as to form different resonance paths via different inductors L1 and L2. Consequently, voltage stresses applied to semiconductor devices in a plasma display panel driving device according to the present invention are reduced to half of those in an existing plasma display driving device Table 1 shows a comparison regarding the voltage/current and reactive power of constituent elements between a sustain driving circuit according to the present invention and a conventional sustain driving circuit. The voltage/current and reactive power are determined based on an identical sustain voltage standard.

TABLE 1

| | | Circuit according to the present invention | Conventional circuit | Note |
|---|---|---|---|---|
| Sustain switch | Peak voltage (V) | Vs/2 | Vs | Half voltage |
| | Peak current (A) | Id | Id | Same |
| Energy recovery switch | Peak voltage (V) | Vs/4 | Vs/2 | Half voltage |
| | Peak current (A) | Vs/(4*Zn) | Vs/(2*Zn) | Same |
| Diodes | Peak voltage (V) | Vs/4 | Vs/2 | Half voltage |
| | Peak current (A) | Vs/(4*Zn) | Vs/(4*Zn) | Same |
| Reactive power | W | Cp(Vs/2)^2*Fs/2Zn*) | CpVs^2*Fs/(2Zn*) | Half voltage |

As can be seen from Table 1, all of the semiconductor devices for the sustain discharging circuit according to the present invention have a halved voltage stress, so that high-performance low-priced semiconductor devices can be used. The reactive power of a PDP in the sustain discharging circuit according to the present invention is halved from that of an existing sustain discharging circuit.

As described above, in the present invention, charging and discharging modes, which constitute a sustain mode, are divided into two first and second charging modes, which are pre-charging and post-charging modes, and two first and second discharging modes, which are pre-discharging and post-discharging modes, respectively. A plasma display driving device according to the present invention is designed so that the two charging modes form different resonance paths passing through different inductors and that the two discharging modes also form different resonance paths passing through different inductors. Consequently, voltage stresses applied to the elements of the device are reduced to half of those in an existing plasma display driving device Therefore, high-performance low-priced semiconductor devices can be used to form a plasma display panel driving device according to the present invention, and the reactive power of a plasma display panel can be halved.

The present invention can be implemented as a method, an apparatus, and a system. When the present invention is executed as software, its constituent elements are code segments to execute necessary operations. Programs or code segments may either be stored in a processor-readable medium or be transmitted via a computer data signal combined with a carrier in a transmission medium or on a communication network. The processor-readable medium can be any medium that can store or transmit information. Examples of the processor-readable medium include electronic circuits, semiconductor memory devices, ROMs, flash memory, $E^2$PROM, floppy disks, optical disks, hard disks, optical fiber media, radio frequency (RF) network, or the like The computer data signal can be any signal that can be propagated over a transmission medium, such as an electronic network channel, an optical fiber, air, an electronic field, an RF network, or the like.

While the present invention has been particularly shown and described with reference to preferred embodiments thereof, it will be understood by those of ordinary skill in the art that various changes in form and details may be made therein without departing from the spirit and scope of the present invention as defined by the following claims.

What is claimed is:

1. A highly-efficient sustain driving device for a plasma display panel, the sustain driving device comprising;

a sustain switching unit connecting first and second terminals of a energy recovery unit to the plasma display panel according to a predetermined sustain discharge sequence; and the energy recovery unit in which, according to a predetermined energy recovery sequence, charging and discharging modes, which constitute a sustain mode, are divided into first and second charging modes and first and second discharging modes, respectively, the first and second charging modes and the first and second discharging modes form different resonance paths, and current flowing along the different resonance paths passes through the first and second terminals and charges/discharges the plasma display panel.

2. The highly-efficient sustain driving device of claim 1, wherein the energy recovery unit includes two inductors, and the first and second charging modes form different resonance paths including different inductors.

3. The highly-efficient sustain driving device of claim 1, wherein the energy recovery unit includes two inductors, and the first and second discharging modes form different resonance paths including different inductors.

4. The highly-efficient sustain driving device of claim 1, wherein the energy recovery sequence is designed so that the duration of the first charging mode is equal to the duration of the second charging mode.

5. The highly-efficient sustain driving device of claim 1, wherein the energy recovery sequence is designed so that the duration of the first discharging mode is equal to the duration of the second discharging mode.

6. The highly-efficient sustain driving device of claim 1, wherein modes that form paths including none of the inductors are included to separate the first and second charging modes and separate the first and second discharging modes.

7. The highly-efficient sustain driving device of claim 1, wherein the sustain switching unit includes four switches, the first through fourth switches are sequentially connected in series, a ground line and a sustain supply voltage are applied to the terminals of the first and fourth switches, respectively, the plasma display panel is connected to a coupling terminal between the second and third switches, and the first and second terminals of the energy recovery unit are connected to a coupling terminal between the first and second switches and a coupling terminal between the third and fourth switches, respectively.

8. The highly-efficient sustain driving device of claim 7, wherein the sustain discharge sequence is designed so that, in the first charging mode, the second switch is turned on while the other switches are turned off, and, in the second charging mode, the third switch is turned on while the other switches are turned off.

9. The highly-efficient sustain driving device of claim 7, wherein the sustain discharge sequence is designed so that, in the first discharging mode, the third switch is turned on while the other switches are turned off, and, in the second discharging mode, the second switch is turned on while the other switches are turned off.

10. The highly-efficient sustain driving device of claim 1, wherein the energy recovery unit comprises:

first and second inductors connected to the first and second terminals;

fifth and sixth switches connected to the terminals of the first and second inductors, respectively, bilaterally switching current according to the predetermined energy recovery sequence;

a charging element block having four capacitors, in which the first through fourth capacitors are sequentially connected in series, a ground line and a sustain supply voltage are applied to the terminals of the first and fourth capacitors, respectively, and the fifth and sixth switches are connected to a coupling terminal between the first and second capacitors and a coupling terminal between the third and fourth capacitors, respectively; and a mode separation unit, in which two diodes for unilaterally switching current are serially connected, the terminals of the two diodes are connected to the first and second terminals, respectively, and a coupling terminal between the two diodes is connected to a coupling terminal between the second and third capacitors, such that the first and second charging modes are separated from each other and the first and second discharging modes are separated from each other.

11. The highly-efficient sustain driving device of claim 7 or 10, wherein the first through sixth switches are MOSFET switches.

12. The highly-efficient sustain driving device of claim 11, wherein the MOSFET switches are turned on on a zero voltage switching condition.

13. The highly-efficient sustain driving device of claim 1, wherein the energy recovery sequence is designed so that the maximum charging voltage of the plasma display panel is divided into two equal voltages and the two equal voltages are charged in the first and second charging modes, respectively.

14. The highly-efficient sustain driving device of claim 1, wherein the energy recovery sequence is designed so that the maximum charging voltage of the plasma display panel is divided into two equal voltages and the two equal voltages are discharged in the first and second discharging modes, respectively.

15. A method of efficiently driving a plasma display panel, the method performed in an energy recovery circuit having two inductors according to a switching sequence in which a reset period, an address period, and a sustain period repeat, wherein charging and discharging modes, which are executed during the sustain period, are divided into first and second charging modes and first and second discharging modes, respectively, the first and second charging modes form different resonance paths that pass different inductors, and the first and second discharging modes also form different resonance paths that pass different inductors; and the switching sequence is controlled to charge/discharge the plasma display panel.

16. The method of claim 15, wherein the energy recovery sequence is designed so that the duration of the first charging mode is equal to the duration of the second charging mode.

17. The method of claim 15, wherein the energy recovery sequence is designed so that the duration of the first discharging mode is equal to the duration of the second discharging mode.

18. The method of claim 15, wherein modes that form paths including none of the inductors are further included to separate the first and second charging modes from each other and separate the first and second discharging modes from each other.

19. The method of claim 15, wherein the energy recovery sequence is designed so that the maximum charging voltage of the plasma display panel is divided into two equal voltages and the two equal voltages are charged in the first and second charging modes, respectively.

20. The method of claim 15, wherein the energy recovery sequence is designed so that the maximum charging voltage of the plasma display panel is divided into two equal voltages and the two equal voltages are discharged in the first and second discharging modes, respectively.

21. A system for driving a plasma display panel according to a switching sequence in which a reset period, an address period, and a sustain period repeat, the system comprising:

an Y-electrode sustain driving circuit dividing charging and discharging modes, which are executed to apply a high-frequency square wave voltage to Y electrodes of the plasma display panel during a sustain period, into first and second charging modes and first and second discharging modes, respectively, forming different resonance paths, which pass different inductors, for the first and second charging modes and different resonance paths, which pass different inductors, for the first and second discharging modes, and driving the Y electrodes of the plasma display panel to be charged/discharged;

a separating and reset circuit separating a circuit operation during the sustain period, a circuit operation during the address period, and a circuit operation during the rest period from one another and applying a lamp-type high-pressure voltage during the reset period;

a scan pulse generator applying a horizontal synchronization signal during the address period and being short-circuited during the other periods; and an X-electrode sustain driving circuit dividing charging and discharging modes, which are executed to apply a high-frequency square wave voltage to X electrodes of the plasma display panel during a sustain period, into first and second charging modes and first and second discharging modes, respectively, forming different resonance paths, which pass different inductors, for the first and second charging modes and different resonance paths, which pass different inductors, for the first and second discharging modes, and driving the X electrodes of the plasma display panel to be charged/discharged.

22. The system of claim 21, wherein the Y-electrode or X-electrode sustain driving circuit comprises:

first and second inductors to first and second terminals.

fifth and sixth switches connected to the terminals of the first and second inductors, respectively, bilaterally switching current according to the predetermined energy recovery sequence;

a charging element block having four capacitors, in which the first through fourth capacitors are sequentially connected to one another in series, a ground line and a sustain supply voltage are applied to the terminals of the first and fourth capacitors, respectively, and the fifth and sixth switches are connected to a coupling terminal between the first and second capacitors and a coupling terminal between the third and fourth capacitors, respectively; and a mode separation unit, in which two diodes for unilaterally switching current are serially connected together, the terminals of the two diodes are connected to the first and second terminals, respectively, and a coupling terminal between the two diodes is connected to a coupling terminal between the second and third capacitors, such that the first and second charging modes are separated from each other and the first and second discharging modes are separated from each other.

23. The system of claim 21, wherein the energy recovery sequence is designed so that the duration of the first charging mode is equal to the duration of the second charging mode.

24. The system of claim 21, wherein the energy recovery sequence is designed so that the duration of the first discharging mode is equal to the duration of the second discharging mode.

25. The system of claim 21, wherein modes that form paths including none of the inductors are included to separate the first and second charging modes and separate the first and second discharging modes.

26. The system of claim 21, wherein the energy recovery sequence is designed so that the maximum charging voltage of the plasma display panel is divided into two equal voltages and the two equal voltages are charged in the first and second charging modes, respectively.

27. The system of claim 21, wherein the energy recovery sequence is designed so that the maximum charging voltage of the plasma display panel is divided into two equal voltages and the two equal voltages are discharged in the first and second discharging modes, respectively.

* * * * *